US008511104B2

(12) United States Patent
Lee et al.

(10) Patent No.: US 8,511,104 B2
(45) Date of Patent: Aug. 20, 2013

(54) APPARATUS AND METHOD FOR CONTROLLING DRIVING OF FAN MOTOR FOR REFRIGERATOR

(75) Inventors: Dong-Il Lee, Seoul (KR); Hyoun-Jeong Shin, Seoul (KR)

(73) Assignee: LG Electronics Inc., Seoul (KR)

( * ) Notice: Subject to any disclaimer, the term of this patent is extended or adjusted under 35 U.S.C. 154(b) by 347 days.

(21) Appl. No.: 12/444,929

(22) PCT Filed: Oct. 8, 2007

(86) PCT No.: PCT/KR2007/004903

§ 371 (c)(1),
(2), (4) Date: Apr. 9, 2009

(87) PCT Pub. No.: WO2008/044847

PCT Pub. Date: Apr. 17, 2008

(65) Prior Publication Data

US 2010/0010676 A1 Jan. 14, 2010

(30) Foreign Application Priority Data

Oct. 11, 2006 (KR) ..... 10-2006-0098996

(51) Int. Cl.
*F25D 17/06* (2006.01)

(52) U.S. Cl.
USPC ..... 62/186; 62/89; 62/150

(58) Field of Classification Search
USPC ..... 62/228.1, 186, 150, 89, 177
See application file for complete search history.

(56) References Cited

U.S. PATENT DOCUMENTS 6,006,530 A * 12/1999 Lee et al. ..... 62/187
2006/0260347 A1 * 11/2006 Coulter et al. ..... 62/344

FOREIGN PATENT DOCUMENTS

JP 2005282952 A * 10/2005
KR 10-0190122 1/1999
KR 10-1999-0031544 5/1999
KR 10-1999-0048384 7/1999

OTHER PUBLICATIONS

JP 2005-282952 (English Translation).*
International Search Report dated Jan. 14, 2008.

* cited by examiner

*Primary Examiner* — Marc Norman
*Assistant Examiner* — Johnathan Bradford
(74) *Attorney, Agent, or Firm* — KED & Associates, LLP

(57) ABSTRACT

Disclosed is an apparatus and a method for controlling a driving of a fan motor for a refrigerator. In a normal driving mode that a temperature of the inside of the refrigerator is higher than a predetermined temperature, the fan motor is driven in a normal speed, and in a waiting mode that the temperature of the inside of the refrigerator is lower than the predetermined temperature, the fan motor is driven in a driving speed very lower than that of the normal driving mode, without stopping of the fan motor, accordingly it is capable of preventing moisture introduced into the fan motor from being frozen, thereby preventing the fan motor from being locked.

11 Claims, 4 Drawing Sheets

APPARATUS AND METHOD FOR CONTROLLING DRIVING OF FAN MOTOR FOR REFRIGERATOR

TECHNICAL FIELD

The present invention disclosure relates to an apparatus and a method for controlling a driving of a fan motor for a refrigerator, and more particularly, to an apparatus and a method for controlling a driving of a fan motor for a refrigerator which is capable of preventing the fan motor from being locked, which is caused by a moisture freezing.

BACKGROUND ART

FIG. 1 is a longitudinal lateral view showing a fan apparatus of a related refrigerator which is disclosed in Japanese Patent No. 3640815.

Referring to FIG. 1, the related fan apparatus includes a motor frame 21 formed of a synthetic resin and having a bracket insertion hole 28; a bracket 35 having a passing portion 37 which is forcibly pressed into the bracket insertion hole 28; and a stator 23 including a stator core, a stator coil installed at the stator core and a mold layer 50 formed of a synthetic resin and installed to mold the stator core and the stator coil, and located outer circumference of the passing portion 37 protruded from the bracket insertion hole 28 to be supported by the passing portion 37, the motor frame 21 and the like Furthermore, the related fan apparatus includes a rotator including a rotation shaft 25 passing through the passing portion 37 and rotatably supported at the bracket 35 through a bearing, a rotator joint 62 installed at an end portion in the opposite side of the motor frame 21 so as to cover the stator 23 from the outside and a rotator magnet installed at the inside of the rotator joint 62 to face an outer circumferential surface of the stator core 45 to each other with a certain gap therebetween, and a fan 27 installed at the outside of the rotator joint 62 to be rotated integrally with the rotator joint. And a passing portion for sealing 29 interposed between the passing portion 37 and the mold layer 50 under a pressed state is installed at an edge portion of the bracket insertion hole 28.

Therefore, the related fan apparatus enhances a sealing characteristic of an aligning surface of the motor frame 21 and the mold layer 50 and the aligning surface of the motor frame 21 and the bracket 35 so as to prevent water from being introduced into the stator 23.

Also, the related fan apparatus is provided with a space 54 having a ring shape and formed between the motor frame 21 and the mold layer 50 to be located outside of the passing portion for sealing. And, the rotator joint 62 has a cup shape having an opened portion at one end portion of the motor frame 21 and a closed portion at the other portion of the motor frame 21, and is installed for the opened portion to be towards a lower side of an inclination.

Therefore, it is capable of preventing a capillary phenomenon from being generated at the ring-shaped space 54, accordingly preventing water from being introduced into the passing portion for sealing 29 from the space 54. And, even when the water is introduced into the rotator joint 62, the water can be easily drained to the outside from the opened portion of the rotator joint 62 because the rotator joint 62 has the cup shape.

Also, FIG. 2 is a longitudinal lateral view showing a related centrifugal fan apparatus having a waterproof structure which is disclosed in Japanese Patent No. 3694224, which shows a fan having a labyrinth structure so as to prevent moisture from being introduced into the fan motor from the outside.

Two fan apparatuses abovementioned have the structure for preventing moisture from being introduced into the fan motor from the outside or for properly draining the introduced moisture.

However, in such structure, when moisture is introduced to the inside of the fan motor (between air gaps), that is the waterproof or the drain is not properly performed, due to dew condensation or moisture introduction, the introduced moisture can be frozen due to a low temperature (below zero) inside of the refrigerator during a waiting time after the motor is stopped (waiting mode), thereby locking (impeding or stopping) the operation of the fan motor.

DISCLOSURE OF INVENTION

Technical Problem

The present inventors recognized the drawbacks of the related art described above. Based upon such recognition, the following features have been conceived.

Therefore, it is an object of the present invention to provide an apparatus and a method for controlling driving a fan motor for a refrigerator which is capable of preventing an operation of the motor from being locked due to moisture freezing.

Technical Solution

The present invention is directed to providing an apparatus for controlling a driving of a fan motor for a refrigerator in accordance with the present invention, the apparatus comprising: a temperature detecting unit for detecting a temperature of the inside of the refrigerator; and a controlling unit controlling the fan motor to be driven with different speeds in a normal driving mode and a waiting mode, based on the temperature detected by the temperature detecting unit.

Preferably, in the waiting mode, the fan motor may be driven in a driving speed corresponding to 10%~30% of that in the normal driving mode.

Preferably, the controlling unit may stop the operation of a compressor when the detected temperature is lower than a predetermined temperature, and then drive the fan motor in a low speed. Or, when the detected temperature is higher than the predetermined temperature, the compressor may be operated, and the fan motor may be driven in a normal speed.

Preferably, the low speed indicates a speed by which moisture introduced into the fan motor can not be frozen.

Further, in accordance with another aspect, the present invention is directed to providing a method for controlling of a driving of a fan motor for a refrigerator, the method comprising: detecting a temperature of the inside of the refrigerator; and driving the fan motor with different speeds in a normal driving mode and a waiting mode, based on the detected temperature.

Preferably, in the waiting mode, the fan motor may be driven in a driving speed corresponding to 10%~30% of that in the normal driving mode.

Preferably, the step of driving the fan motor may comprise: comparing the detected temperature with a predetermined temperature; and stopping an operation of the compressor and driving the fan motor in a low speed, when the detected temperature is lower than the predetermined temperature.

Preferably, the low speed indicates a speed by which moisture introduced into the fan motor can not be frozen.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiment of the invention and together with the description serve to explain the principles of the invention.

In the drawings.

MODE FOR THE INVENTION

Hereinafter, reference description will be made given in detail to of the preferred embodiments of the present invention.

In the description of the present invention, detailed description of disclosed functions or configurations will be omitted in order to represent the concept of the present invention more obviously.

Generally, an outer rotor type fan motor which is capable of being fabricated to be compact with respect to a diametric and an axial directions is applied to a cool air blowing fan with considering a space to be installed in a refrigerator.

Figure 1:
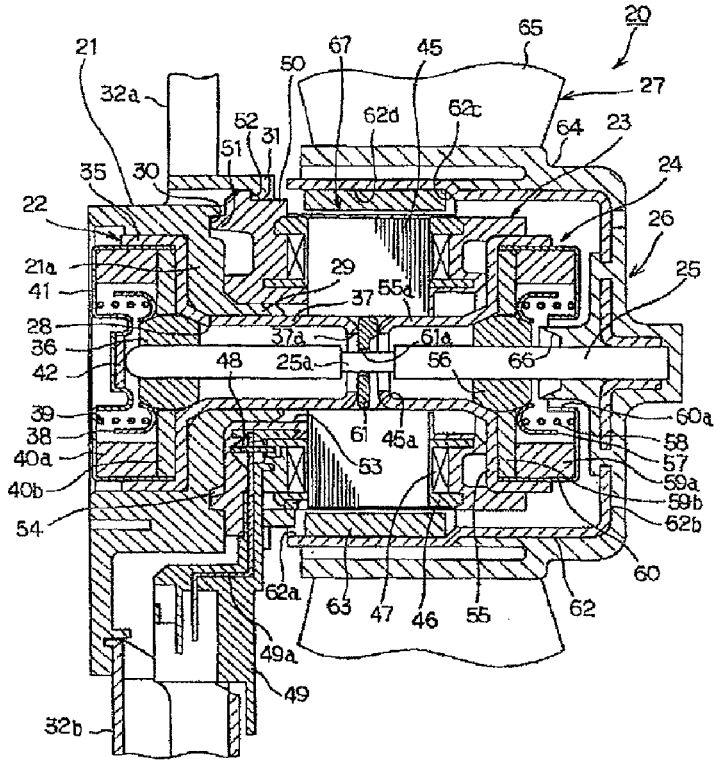
FIG. 1 is a longitudinal lateral view showing a fan apparatus of a related refrigerator.
Figure 2:
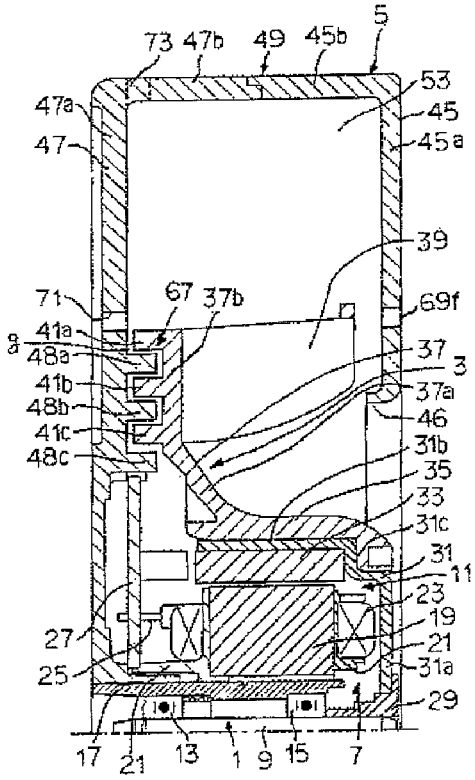
FIG. 2 is a longitudinal lateral view showing a centrifugal fan apparatus having a waterproof structure.
Figure 3:
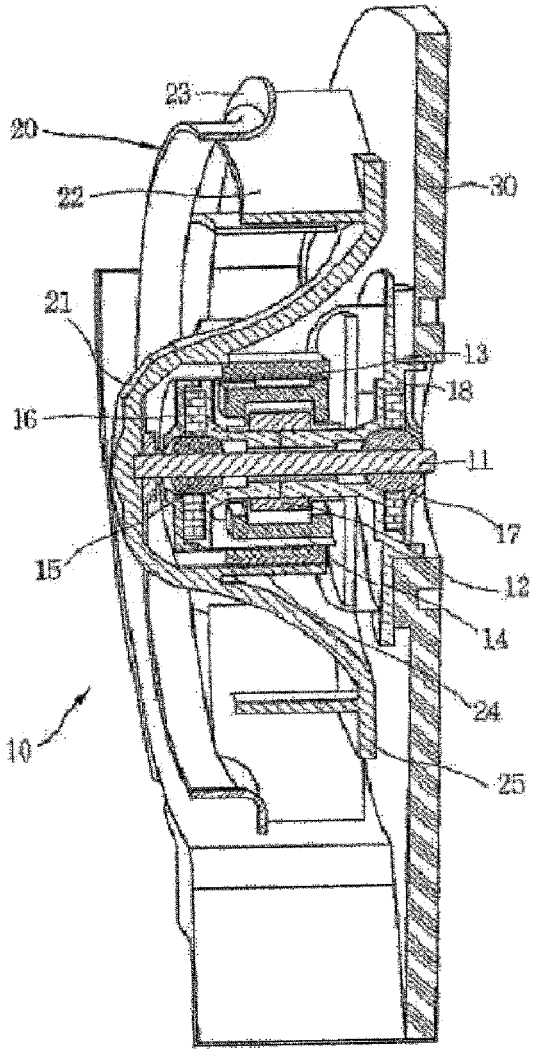
FIG. 3 is a sectional perspective view showing an outer rotor type fan motor in accordance with the present invention.

FIG. 3 is a perspective view showing an outer rotor type fan motor in accordance with the present invention.

As shown in FIG. 3, the outer rotor type fan motor 10 may include a rear portion bearing assembly 17 disposed at a casing (not shown), a stator 12 disposed at the rear portion bearing assembly 17, a front portion bearing assembly 15 disposed at the stator 12, and fan portion 20 having a rotation shaft 11 which is supported by the front and rear portion bearing assemblies 15, 17 to be freely rotated, at a central portion thereof.

The fan portion 20 may be formed of a synthetic resin, and further include a fan body 21 formed at the central portion thereof, a hub 24 formed at an inner space of the fan body 21 with a cylindrical shape, a plurality of blades 22 formed at an outer circumferential surface of the hub 24 in the diametric direction, a blade support portion 23 formed at an upper portion of the blades 23 and a fan base portion 25 extended from the fan body 21.

A permanent magnet 13 may be mounted at an inner circumferential surface of the hub 24, and the stator 12 may be installed at the inside of the permanent magnet 13 with a certain distance from the permanent magnet 13. And, the rotation shaft 11 may be coupled to the central portion of the inside of the fan body 21. And, a motor mount 30 may be installed at an outer surface of the fan base portion 25 so as to support the outer rotor type fan motor 10.

In the outer rotor type fan motor 10 configured thereabove, the rotation shaft 11 of the hub 24 may be supported at the front portion bearing assembly 15 and the rear portion bearing assembly 17, and the permanent magnet 13 may be disposed to face the stator 12 with a certain distance. Accordingly, the hub 24 at which the permanent magnet 13 is mounted may be rotated by an interaction of the stator 12 and the permanent magnet 13, and then the fan body 21 and the blade 22, which are integrated with the hub 24 may be also rotated by the rotation of the hub 24

Figure 4:
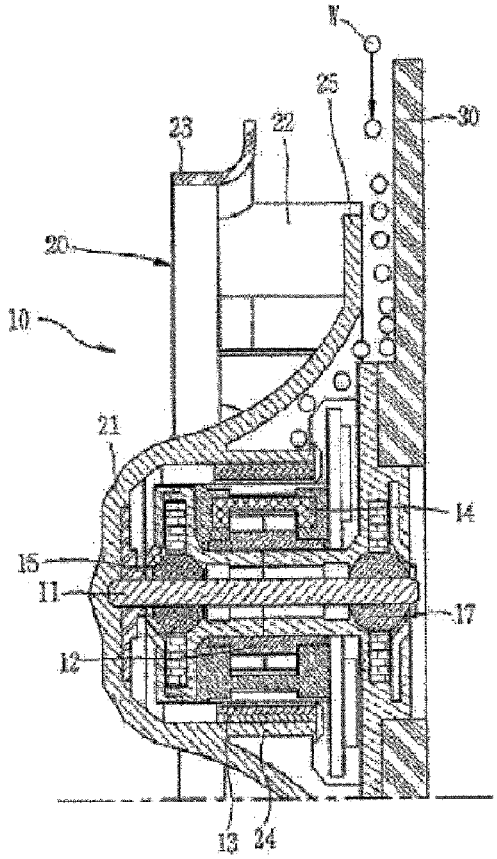
FIG. 4 is a sectional view showing a state that moisture is introduced into the outer rotor type fan motor in FIG. 3.

However, in the outer rotor type fan motor 10, as shown in FIG. 4, in case of a defrosting mode of the refrigerator, moisture (W) formed on a passage may fall, and then be introduced into the outer rotor type fan motor 10.

Here, if the temperature inside of the refrigerator is lower than that predetermined by a user, the compressor may be stopped. Accordingly, the outer rotor type fan motor 10 is also stopped (entering a waiting mode). That is, the moisture introduced into the outer rotor type fan motor 10 may be frozen by cool air inside of the refrigerator when the fan motor is stopped, accordingly the operation of the outer rotor type fan motor 10 may be locked.

Therefore, the present invention involves the recognition of the drawback in that the operation of the outer rotator type fan motor 10 is locked due to the freezing of the moisture introduced into the outer rotor type fan motor 10.

Figure 5:
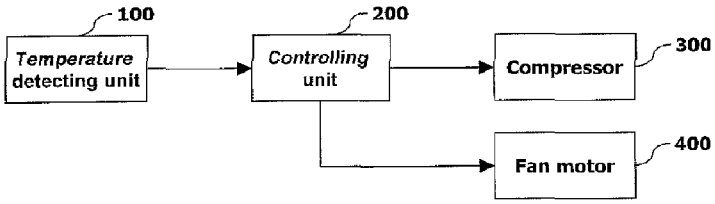
FIG. 5 is a block diagram of an apparatus for controlling a driving of a fan motor for a refrigerator in accordance with the present invention.

FIG. 5 is a block diagram of an apparatus for controlling the driving of the fan motor for the refrigerator in accordance with the present invention.

As shown in FIG. 5, the apparatus for controlling the driving of the fan motor for the refrigerator in accordance with the present invention may include a temperature detecting unit 100, a controlling unit 200, a compressor 300 and a fan motor 400.

The temperature detecting unit 100 may detect the inner temperature of the refrigerator.

The controlling unit 200 may compare the temperature detected by the temperature detecting unit 100 with a predetermined temperature (e.g., standard temperature), and control the driving of the compressor 300 and the fan motor 400 in a normal driving mode or a waiting mode, based on the comparing result.

That is, the controlling unit 200 may operate the compressor 300 in the normal driving mode and drive the fan motor 400 in a normal speed when the temperature detected by the temperature detecting unit 100 is higher than the predetermined temperature. Meanwhile, the controlling unit 200 may stop the operation of the compressor 300 by entering the waiting mode and drive the fan motor 400 in a low speed when the temperature detected by the temperature detecting unit 100 is lower than the predetermined temperature. Preferably, the low speed indicates a speed by which moisture introduced into the fan motor 400 can not be frozen, corresponding to approximately 10%~30% of the normal speed.

Preferably, the fan motor 400 refers to the outer rotor fan motor 10 in FIGS. 3 and 4 for describing conveniently.

The operation will be described in detail as follows.

Figure 6:
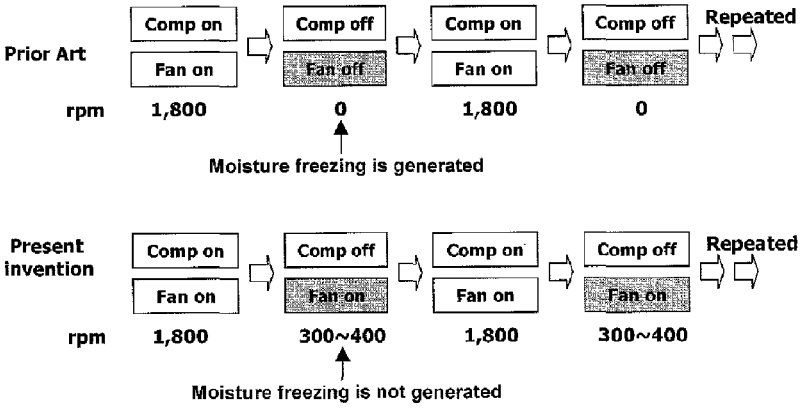
FIG. 6 shows an operation of the apparatus for controlling the driving of the fan motor for the refrigerator in accordance with the present invention.

FIG. 6 briefly shows the operation of the apparatus for controlling the driving of the fan motor for the refrigerator in accordance with the present invention.

As shown in FIG. 6, in the refrigerator, the normal mode in which the fan motor 400 is normally driven and the waiting mode (or waiting state mode) in which the operation of the fan motor 400 is temporally stopped according to a driving rate (50%~80%) are alternately performed. And, the controlling unit 200 may stop the operation of the compressor 300 and the fan motor 400 during the waiting mode.

However, when moisture is introduced into the fan motor 400 during the waiting mode, the introduced moisture may become frozen due to a low temperature of the inside of the refrigerator, thereby locking the driving of the fan motor 400.

Therefore, in the present invention, the fan motor 400 is not stopped and driven during the waiting mode in order to prevent the moisture introduced into the fan motor from being frozen. That is, the controlling unit 200 may drive the fan motor 400 in the normal speed (approximately 1800 rpm) in the normal driving mode (forward rotation or backward rotation), while the fan motor 400 may be driven in the low speed (30% of the normal speed or below) in the waiting mode, thereby preventing the motor from being locked due to the freezing resulting from moisture introduction. Preferably, the normal speed may be approximately 1700 rpm~2000 rpm, and the low speed may be approximately 300~400 rpm. In other words, by the controlling unit 200, when the temperature detected by the temperature detecting unit 100 is lower than the predetermined temperature, the fan motor 400 may be driven in the speed corresponding to approximately 10%~30% of the normal speed.

Hereinafter, a method for controlling the driving of the fan motor for the refrigerator in accordance with the present invention will be described in detail with reference to accompanying drawings.

Figure 7:
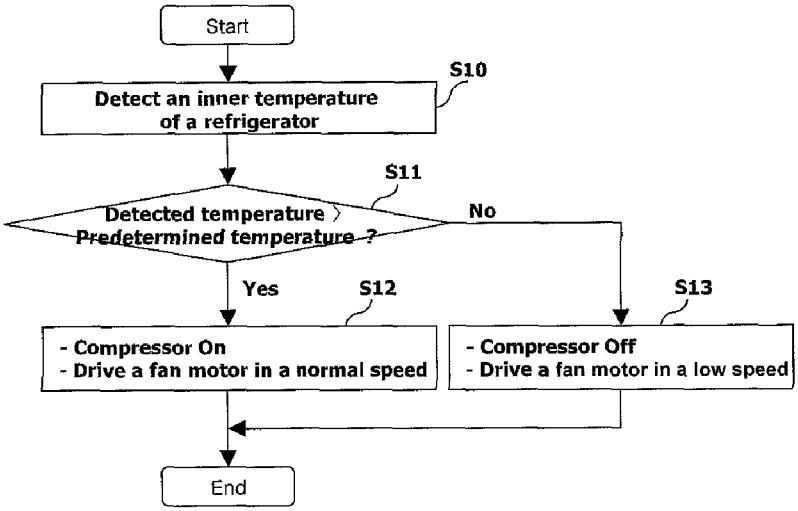
FIG. 7 is a flow chart showing a method for controlling the driving of the fan motor for the refrigerator in accordance with the present invention.

FIG. 7 is a flow chart showing the method for controlling the driving of the fan motor for the refrigerator in accordance with the present invention, As shown in FIG. 7, when the refrigerator is operated, the compressor 300 may compress a refrigerant by using an induction motor, and the fan motor 400 may blow cool air generated by the refrigerant compressing by the compressor 300 in the refrigerator.

In this state, the temperature detecting unit 100 detect the temperature of the inside of the refrigerator in a certain time period and output the detecting result to the controlling unit 200, and then the controlling unit 200 receives the temperature detected by the temperature detecting unit 100 (S10) so as to control the operation of the compressor 300 and the fan motor 400 in the normal driving mode and the waiting mode, respectively.

To achieve this, the controlling unit 200 compares the temperature detected by the temperature detecting unit 100 and the temperature predetermined by the user (e.g., standard temperature), accordingly can distinguish the driving mode (normal driving mode or waiting mode) (S11). The user should set the desiring temperature of the inside of the refrigerator and store the temperature at a certain memory region (not shown) in the controlling unit 200 in advance.

As the comparing result, if the temperature detected by the temperature detecting unit 100 is higher than the temperature predetermined by the user, the controlling unit 200 determines as the normal driving mode, accordingly the compressor 300 is operated and the fan motor 400 is driven in the normal speed (1800 rpm) (S12).

On the contrary, if the temperature detected by the temperature detecting unit 100 is lower than the temperature predetermined by the user, the controlling unit 200 determines as the waiting mode, accordingly the compressor 200 is stopped and the fan motor 400 is driven in the low speed (300~400 rpm) (S13). That is, in the present invention, the fan motor 400 may be continuously rotated forwardly or backwardly in the very low speed (30% of the normal speed or below) even in the waiting mode so as to prevent freezing.

Accordingly, even if moisture is introduced between the air gaps of the fan motor 400 which applies the outer rotor type motor, the fan motor 400 is continuously driven regardless of the operation of the compressor 300, thereby being capable of preventing the motor from being locked, which is caused by freezing of the introduced moisture.

As aforementioned, in accordance with the present invention, when the fan motor for the refrigerator is driven, the fan motor can be continuously driven even in the waiting mode, accordingly it is capable of preventing moisture introduced between the air gaps of the fan motor from being frozen, thereby preventing the motor from being locked and enhancing the reliability of the product.

The foregoing embodiments and advantages are merely exemplary and are not to be construed as limiting the present invention disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present inventive features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

The invention claimed is:

1. An apparatus for controlling a driving of a fan motor for a cooling evaporator of a refrigerator having a compressor and the fan motor comprising:

a temperature detecting unit for detecting a temperature of an inside of a food storage chamber of the refrigerator; and a controlling unit controlling an operation of the compressor and a driving speed of the fan motor based on the temperature detected by the temperature detecting unit by choosing one of a plurality of driving modes of the fan motor wherein the fan motor is driven without stopping even when an operation of the compressor is stopped, wherein the plurality of driving modes comprises a normal driving mode in which the fan motor is driven at a normal speed while the compressor is operated when the temperature detected by the temperature detecting unit is higher than the temperature predetermined by the user and a waiting mode in which the fan motor is driven at a lower speed than the normal speed while the compressor is stopped when the temperature detected by the temperature detecting unit is lower than the temperature predetermined by the user.

2. The apparatus of claim 1, wherein the lower speed represents a slower speed than a normal speed of the fan motor for the refrigerator.

3. The apparatus of claim 1, wherein the lower speed represents 10-30% of the normal speed.

4. The apparatus of claim 1, wherein the normal speed is in the range of about 1700 rpm to about 2000 rpm.

5. The apparatus of claim 1, wherein the lower speed is in the range of about 300 rpm to about 400 rpm.

6. The apparatus of claim 1, wherein the controlling unit is further configured to modify the driving mode of the fan motor when the operational state of the compressor is modified.

7. The apparatus of claim 1, wherein the controlling unit comprises a comparator configured to compare the inside food storage chamber temperature of the refrigerator with a predetermined temperature.

8. A method for controlling a driving of a fan motor for a cooling evaporator of a refrigerator, the method comprising:

detecting the inside food storage chamber temperature of the refrigerator;

comparing the detected temperature with a preselected temperature;

generating a control signal according to a result of the comparison in order to determine the driving speed mode of the fan motor corresponding to an operation state of the compressor, wherein the driving speed mode comprises a normal driving mode which indicates that the fan motor is driven at a normal speed while the operation state of the compressor is On when the temperature detected is higher than the temperature predetermined by the user and a waiting mode which indicates that the fan motor is driven at low speed while the operation state of the compressor is Off when the temperature detected is lower than the temperature predetermined by the user;

determining the driving speed mode of the fan motor based on an inside food storage chamber temperature of the refrigerator; and controlling the driving speed of the fan motor according to the determined driving speed mode, wherein the fan motor is driven without stopping even if an operation of the compressor is stopped.

9. The method of claim 8, wherein the step of the generating comprises:

in response to the result of the comparison, if the detected temperature is higher than the preselected temperature, generating the control signal for driving the fan motor at the normal speed, if the detected temperature is lower than the preselected temperature, generating the control signal for driving the fan motor in the low speed and for stopping the operation of the compressor.

10. The method of claim 8, wherein the step of the determining comprises:

if the inside food storage chamber temperature of the refrigerator is higher than the preselected temperature, determining the normal driving mode, and if the inside temperature of the refrigerator is lower than the preselected temperature, determining the waiting mode.

11. The method of claim 8, wherein the low speed indicates a speed by which moisture introduced into the fan motor cannot be frozen.

* * * * *